US010065821B2

(12) United States Patent
Takada et al.

(10) Patent No.: US 10,065,821 B2
(45) Date of Patent: Sep. 4, 2018

(54) ACCOMMODATING DEVICE AND IMAGE FORMING APPARATUS

(71) Applicant: Konica Minolta, Inc., Chiyoda-ku, Tokyo (JP)

(72) Inventors: Hiroaki Takada, Mitaka (JP); Naoki Watanabe, Ebina (JP); Daisuke Kawate, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/399,787

(22) Filed: Jan. 6, 2017

(65) Prior Publication Data

US 2017/0217704 A1 Aug. 3, 2017

(30) Foreign Application Priority Data

Jan. 28, 2016 (JP) ..... 2016-014777

(51) Int. Cl.

| | |
|---|---|
| ***B65H 7/08*** | (2006.01) |
| ***B65H 7/04*** | (2006.01) |
| ***B65H 5/06*** | (2006.01) |
| ***B65H 31/00*** | (2006.01) |
| ***G03G 15/00*** | (2006.01) |
| *B65B 69/00* | (2006.01) |
| *B65B 61/18* | (2006.01) |

(52) U.S. Cl.
CPC ..... *B65H 7/04* (2013.01); *B65H 5/062* (2013.01); *B65H 31/00* (2013.01);
(Continued)

(58) Field of Classification Search
CPC ..... B65H 2701/139; B65H 2701/1849; B65H 2701/1944; B65H 2701/511; B69B 69/00;
(Continued)

(56) References Cited

U.S. PATENT DOCUMENTS 4,571,140 A * 2/1986 Yamada ..... G03B 42/045 414/411
4,696,615 A * 9/1987 Ettischer ..... B65B 69/0033 271/157

(Continued)

FOREIGN PATENT DOCUMENTS

JP 06191657 A * 7/1994
JP 06227527 A * 8/1994

(Continued)

*Primary Examiner* — Howard J Sanders
(74) *Attorney, Agent, or Firm* — Buchanan Ingersoll & Rooney PC

(57) ABSTRACT

Provided are an accommodating device that performs appropriate processing in order to discard an empty paper pack remaining in the accommodating device and an image forming apparatus including the accommodating device. The accommodating device includes an accommodating unit, a processing unit, and a discarding unit. The accommodating unit accommodates a paper pack including a bundle of stacked sheets of printer paper wrapped with wrapping paper in such a manner that the printer paper is freely taken out. The processing unit flatly crushes and conveys an empty paper pack from which all of the sheets of the printer paper have been taken out and in which only the wrapping paper has remained. The discarding unit stores a flatly crashed empty paper pack conveyed from the processing unit in order to discard them.

18 Claims, 5 Drawing Sheets

(52) U.S. Cl.
CPC ..... *G03G 15/6529* (2013.01); *B65B 61/18* (2013.01); *B65B 69/00* (2013.01); *B65B 69/0025* (2013.01); *B65H 2701/139* (2013.01); *B65H 2701/1849* (2013.01); *B65H 2701/1944* (2013.01); *B65H 2801/06* (2013.01)

(58) Field of Classification Search
CPC . B69B 69/0025; B65B 69/00; B65B 69/0025; B65B 61/18
See application file for complete search history.

(56) References Cited

U.S. PATENT DOCUMENTS

| | | | | | |
|---|---|---|---|---|---|
| 5,055,869 | A * | 10/1991 | DiPietro | ..... | G03B 42/045 206/455 |
| 8,567,293 | B2 * | 10/2013 | Freudenberg | ..... | B65B 69/0025 53/382.1 |
| 2016/0145060 | A1 * | 5/2016 | Ohno | ..... | G03G 15/6511 271/153 |

FOREIGN PATENT DOCUMENTS

| | | | | |
|---|---|---|---|---|
| JP | 2000275749 | A | * | 10/2000 |
| JP | 2003095456 | A | | 4/2003 |
| JP | 2003276865 | A | * | 10/2003 |
| JP | 2004136984 | A | * | 5/2004 |
| JP | 2005200111 | A | * | 7/2005 |
| JP | 2007055768 | A | * | 3/2007 |
| JP | 2011201704 | A | * | 10/2011 |

* cited by examiner

ACCOMMODATING DEVICE AND IMAGE FORMING APPARATUS

CROSS-REFERENCE TO RELATED APPLICATION

This application is based on Japanese Patent Application No. 2016-014777 filed on Jan. 28, 2016, the contents of which are incorporated herein by reference.

BACKGROUND

1. Field of the Invention

The present invention relates to an accommodating device and an image forming apparatus.

2. Description of Related Art

An image forming apparatus such as a copier, a facsimile, or a printer equips an accommodating device (paper feeding trays) for accommodating a bundle of stacked sheets of printer paper (hereinafter referred to as "paper bundle") thereinside or in an external paper feeding device. When a user supplies paper in such an accommodating device, the user needs to prepare a paper pack including a paper bundle wrapped with wrapping paper, take out the paper bundle from the paper pack, and then place it in the accommodating device. In order to reduce such a burden of the user, various techniques have conventionally been proposed. See Japanese Patent Publication No. 2003-95456.

The technique of the publication proposes a paper feeding device that automatically removes the wrapping paper of a paper pack thereinside. In the technique, a user can just directly place a paper pack in the paper feeding device when supplying paper. The removed wrapping paper is discarded into a trash can (a discarding unit) in the paper feeding device.

However, in many cases, such a discarding unit as mentioned above is arranged in a limited space in a paper feeding device and does not have sufficient capacity. Furthermore, an empty paper pack remains in an opened state in the paper feeding device. Due to this, when the empty paper pack is conveyed to the discarding unit insufficient in capacity, the discarding unit soon becomes full depending on the shape and the like of the empty paper pack. In this case, a user needs to frequently discard empty paper packs stored in the discarding unit.

SUMMARY

The present invention is made in view of the above circumstances. Thus, an object of the present invention is to provide an accommodating device that performs appropriate processing in order to discard an empty paper pack remaining in the accommodating device and an image forming apparatus comprising the accommodating device.

To achieve at least one of the abovementioned objects, an accommodating device reflecting one aspect of the present invention comprises an accommodating unit that accommodates a paper pack including a bundle of stacked sheets of printer paper wrapped with wrapping paper in such a manner that the printer paper is freely taken out; a processing unit that flatly crushes and conveys an empty paper pack which all of the sheets of the printer paper have been taken out from the paper pack and only the wrapping paper has remained; and a discarding unit configured to discard a flatly crashed empty paper pack which is obtained by crushing the empty paper pack and is conveyed from the processing unit.

In the accommodating device, the processing unit preferably starts to crush the empty paper pack from a wall surface except for a wall surface on a paper feeding side among wall surfaces of the paper pack along a direction of stacking of the sheets of the printer paper.

In the accommodating device, the processing unit preferably starts to crush the empty paper pack from a wall surface opposing the wall surface on the paper feeding side among the wall surfaces of the paper pack along the direction of stacking of the sheets of the printer paper.

In the accommodating device, the processing unit preferably starts to crush the empty paper pack from a wall surface adjacent to the wall surface on the paper feeding side among the wall surfaces of the paper pack along the direction of stacking of the sheets of the printer paper.

In the accommodating device, the processing unit preferably moves to a position of the empty paper pack when crushing the empty paper pack.

The accommodating device preferably further comprises a conveying unit that conveys the empty paper pack to a position of the processing unit when the processing unit crushes the empty paper pack.

In the accommodating device, the conveying unit preferably holds the empty paper pack having any size in a position overlapping with a minimum-size empty paper pack in which minimum-size sheets of the printer paper had been wrapped, when seen in a plan view by assuming that the minimum-size empty paper pack is mounted in the accommodating unit so as to be able to hold even the minimum-size empty paper pack, and moves to a direction of the processing unit, thereby conveying the empty paper pack to the position of the processing unit.

In the accommodating device, the processing unit preferably comprises a pair of rollers that flatly crushes and conveys the empty paper pack by rotating while sandwiching the empty paper pack.

In the accommodating device, the processing unit preferably further comprises a crushing unit that further crushes the flatly crushed empty paper pack from a direction intersecting with a thickness direction of the flatly crushed empty paper pack.

In the accommodating device, the processing unit preferably further comprises a curling-inclination forming unit that forms a curling inclination on the empty paper pack while flatly crushing the empty paper pack; and a rolling unit that cylindrically rolls the empty paper pack having the curling inclination formed thereon by the curling-inclination forming unit, according to the curling inclination.

The accommodating device preferably further comprises a sensor that detects a presence or absence of the printer paper in the paper pack. In the accommodating device, the processing unit preferably starts operation when the sensor detects the absence of the printer paper in the paper pack.

In the accommodating device, the processing unit preferably starts operation when a user issues an instruction to start processing for crushing the empty paper pack.

The objects, features, and characteristics of this invention other than those set forth above will become apparent from the description given herein below with reference to preferred embodiments illustrated in the accompanying drawings.

DETAILED DESCRIPTION

Figure 1:
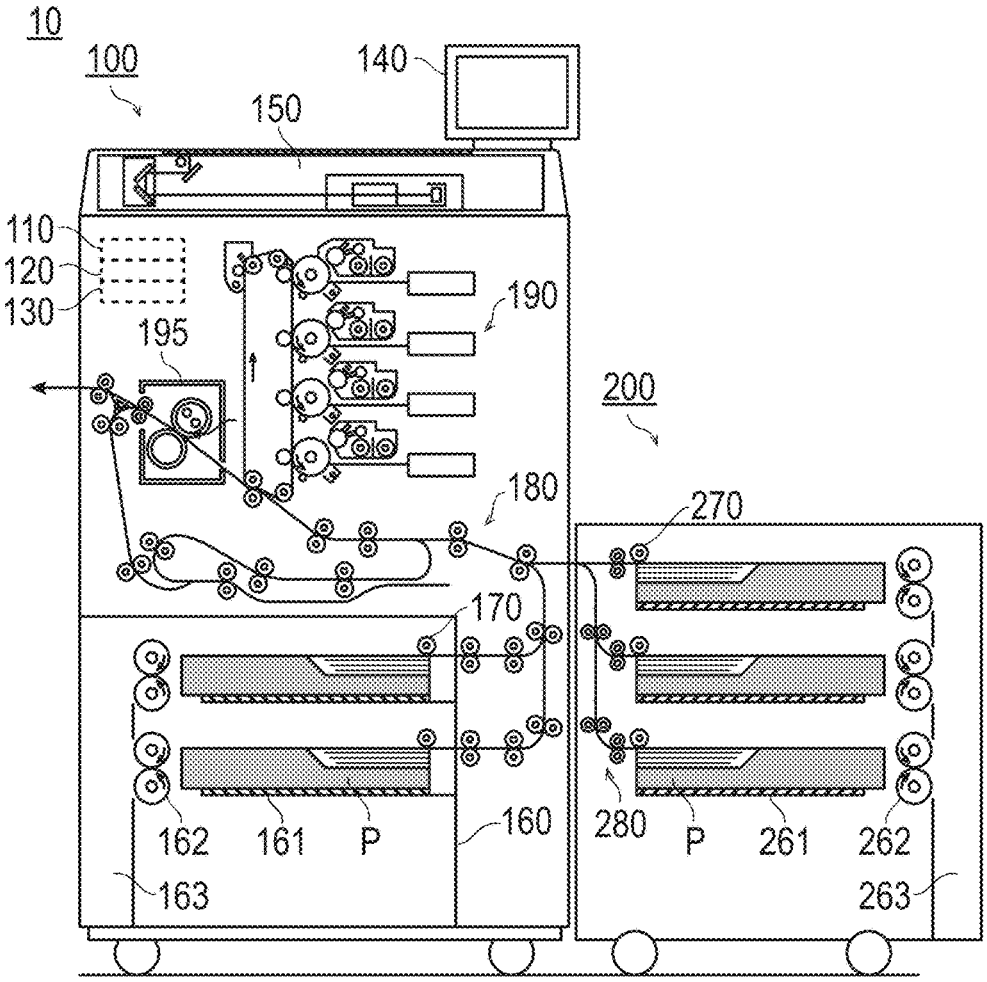
FIG. 1 is a cross-sectional diagram depicting the schematic configuration of an image forming apparatus comprising an accommodating device according to a present embodiment.

Hereinafter, embodiments of the present invention will be described with reference to the accompanying drawings. In the description of the drawings, the same elements are denoted by the same reference numerals, and redundant description is omitted. In addition, in some cases, dimensional ratios in the drawings are exaggerated for descriptive convenience, and thus are different from actual ratios.

First, an image forming apparatus according to a present embodiment will be described.

FIG. 1 is a cross-sectional diagram depicting the schematic configuration of the image forming apparatus comprising an accommodating device according to the present embodiment.

As depicted in FIG. 1, an image forming apparatus 100 comprises a processor 110, a memory 120, a communication unit 130, an operation panel 140, an image reading unit 150, an accommodating device 160, paper feeding rollers 170, a paper conveying unit 180, an image forming unit 190, and a fixing unit 195. Additionally, as depicted in FIG. 1, the image forming apparatus 100 may equip, outside the apparatus, a paper feeding device 200 that feeds printer paper (hereinafter referred to simply as "paper") to the image forming apparatus 100.

The processor 110 is a CPU (Central Processing Unit) and controls the above respective configurations in accordance with a program and executes various kinds of arithmetic processing.

The memory 120 includes a ROM (Read Only Memory) that stores various kinds of programs and various kinds of data, a RAM (Random Access Memory) that, as a work area, temporarily stores programs and data, a hard disk that stores various kinds of programs and various kinds of data, and the like.

The communication unit 130 is an interface for communicating with an other apparatus and receives various instructions and the like from a user of the other apparatus.

The operation panel 140 comprises, for example, a touch panel formed by superimposing a touch sensor on a liquid crystal display, ten keys, a start button, and a stop button. The operation panel 140 displays various kinds of information and receives various instructions from a user.

The image reading unit 150 is arranged on an upper part of a main body of the image forming apparatus 100 and comprises an optical system including a mirror and a lens, and a reading sensor such as a CCD. The image reading unit 150 reads a manuscript and outputs image signals.

The accommodating device 160 comprises a plurality of accommodating units 161 (paper feeding trays) that accommodate a paper pack P including a paper bundle wrapped with wrapping paper. Furthermore, the accommodating device 160 comprises processing units 162 that perform appropriate processing in order to discard the paper pack P accommodated in the accommodating units 161 when the paper pack P becomes empty, and a discarding unit 163. The accommodating device 160 comprises one processing unit 162 for one accommodating unit 161. However, as depicted in FIG. 1, the discarding unit 163 may be arranged for the plurality of accommodating units 161. These configurations are arranged in order of the accommodating unit 161, the processing unit 162, and the discarding unit 163, as seen from a paper feeding side. Details of the accommodating device 160 will be described later.

The paper feeding roller 170 separates each sheet of paper one by one from the paper pack P accommodated in the accommodating device 160 and feeds the each sheet of paper to the paper conveying unit 180 that will be described later. The paper feeding roller 170 is arranged so as to be abutted to the paper in the paper pack P.

The paper conveying unit 180 comprises a plurality of conveying roller pairs and a drive motor (unillustrated) and conveys paper fed from the paper feeding roller 170 to the image forming unit 190 and the fixing unit 195 that will be described later. Alternatively, the paper conveying unit 180 may convey paper fed via a paper feeding roller 270 and a paper conveying unit 280 of a paper feeding device 200 that will be described later.

The image forming unit 190 is, for example, an electrographic image forming unit and comprises a photosensitive drum, a charging unit, an exposure unit, a developing unit, a transfer unit, and a cleaning unit. The image forming unit 190 transfers a toner image on the fed paper.

The fixing unit 195 fixes the toner image transferred on the paper by the image forming unit 190 onto the paper.

The paper feeding device 200 comprises accommodating units 261, processing units 262, a discarding unit 263, paper feeding rollers 270, and a paper conveying unit 280. These configurations are substantially the same as the accommodating device 160 (the accommodating units 161, the processing units 162, and the discarding unit 163), the paper feeding rollers 170, and the paper conveying unit 180 of the image forming apparatus 100, and thus, descriptions thereof will be omitted. The accommodating unit 261, the processing unit 262, and the discarding unit 263 of the paper feeding device 200 are collectively referred to as the accommodating device.

Next, details of the accommodating device 160 will be described. As depicted in FIG. 1, the accommodating device 160 comprises the plurality of accommodating units 161. However, here, the description will be focused on one of the accommodating units 161.

Figure 2:
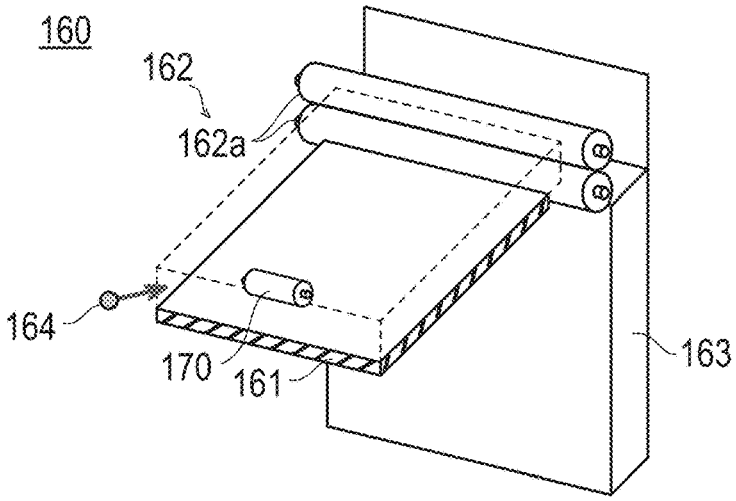
FIG. 2 is a perspective diagram depicting the schematic configuration of the accommodating device.

FIG. 2 is a perspective diagram depicting the schematic configuration of the accommodating device 160.

As depicted in FIG. 2, the accommodating device 160 comprises the accommodating unit 161, the processing unit 162, and the discarding unit 163. The accommodating device 160 may further comprise a sensor 164. In addition, in order to clarify the positional relationship between the respective configurations, the paper feeding roller 170 is also depicted together therewith in FIG. 2.

The accommodating unit 161 accommodates the paper pack P including a paper bundle wrapped with wrapping paper in such a manner that paper is freely taken out from the paper pack P. The accommodating unit 161 comprises a horizontal plate-shaped member capable of mounting the paper pack P thereon, and accommodates the paper pack P including the paper bundle that has been partially or entirely wrapped with wrapping paper. For example, in order to freely take out paper from the paper pack P, the accommodating unit 161 may accommodate the paper pack P in which the wrapping paper has been partially opened by a user. Alternatively, the accommodating unit 161 may accommodate the paper pack P in which the wrapping paper has not been opened at all by the user. In this case, the paper pack P will be opened by any desired configuration of the image forming apparatus 100 by using any selected opening method implemented in the image forming apparatus 100. For convenience, the paper pack P in which the wrapping paper has been partially opened is depicted as in FIG. 1. However, an opened portion is not limited to the example depicted in FIG. 1. Paper is taken out by the paper feeding roller 170 from the paper pack P accommodated in the accommodating unit 161, in which the wrapping paper is partially open. In addition, when paper is taken out by the paper feeding roller 170, the accommodating unit 161 may be capable of moving up and down so that an upper surface of the paper bundle is positioned at a predetermined height. Additionally, in order to regulate the position of the paper pack P, the accommodating unit 161 may further comprise a regulation unit (unillustrated) that regulates positions of some wall surfaces of the paper pack P among the wall surfaces thereof along a direction of stacking of sheets of paper.

The processing unit 162 comprises a pair of rollers (hereinafter referred to as "roller pair 162*a*"). The roller pair 162*a* can be separated from or close to each other. In addition, the roller pair 162*a* can move with respect to the paper pack P, and is on standby near the paper pack P while paper remains in the paper pack P. In the example depicted in FIG. 2, the roller pair 162*a* is on standby at a position facing a wall surface opposing the wall surface on a side where the paper feeding roller 170 is arranged (a paper feeding side) among the wall surfaces of the paper pack P along the direction of stacking of the sheets of paper. The roller pair 162*a* is preferably formed to have a longer width than a width of the paper pack P which the roller pair 162*a* faces.

The processing unit 162 flatly crushes a paper pack from which all of sheets of paper have been taken out and in which only the wrapping paper has remained (hereinafter referred to as "empty paper pack Pe"), and conveys it to the discarding unit 163. Details of the processing by the processing unit 162 will be described later with reference to FIGS. 3A to 3C.

The discarding unit 163 is, for example, formed into a box shape and is a discard space for discarding the flat empty paper packs Pe conveyed from the processing unit 162. As depicted in FIGS. 1 and 2, the discarding unit 163 is arranged immediately behind the processing unit 162 so as to be able to directly receive the empty paper pack Pe conveyed from the processing unit 162.

The sensor 164 optically or mechanically detects a presence or absence of paper in the paper pack P. The sensor 164 can detect the presence or absence of paper in the paper pack P accommodated in the accommodating unit 161, and is arranged in any selected place that does not obstruct feeding of paper by the paper feeding roller 170.

Next, details of processing performed by the accommodating device 160 will be described with reference to FIGS. 3A to 3C. In the present embodiment, the accommodating device 160 is formed so as to perform appropriate processing in order to discard the empty paper pack Pe remaining in the accommodating device 160.

Figure 3A:
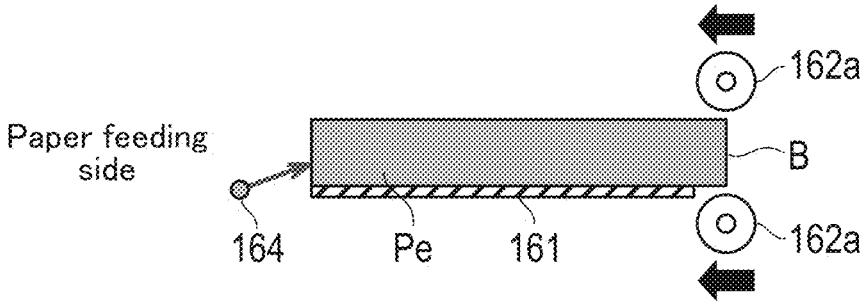
FIG. 3A is a diagram depicting a situation in which a processing unit moves to an empty paper pack.

FIG. 3A is a diagram depicting a situation in which the processing unit 162 moves to the empty paper pack Pe. FIG. 3B is a diagram depicting a situation in which the processing unit 162 crushes the empty paper pack Pe. FIG. 3C is a diagram depicting a situation in which the processing unit 162 conveys the empty paper pack Pe to the discarding unit 163 while crushing. In addition, FIGS. 3A to 3C depict states of the accommodating device 160 as seen from a lateral direction. In FIGS. 3A and 3B, the discarding unit 163 is omitted.

When the sensor 164 detects the absence of paper in the paper pack P accommodated in the accommodating unit 161, the processing unit 162 moves to the position of the empty paper pack Pe from a standby position while separating the roller pair 162*a* from each other, as depicted in FIG. 3A. Specifically, the roller pair 162*a* moves to a position where the pair of rollers 162*a* can sandwich the wall surface on a rear side as seen from the paper feeding side, which is opposing the wall surface on the paper feeding side (hereinafter referred to as "back surface B") among the wall surfaces of the paper pack P along the direction of stacking of the sheets of paper. In the present embodiment, the accommodating unit 161 is formed so as not to support a partial portion of the empty paper pack Pe including the back surface B so that the roller pair 162*a* can sandwich the back surface B of the empty paper pack Pe, as depicted in FIG. 3A.

Figure 3B:
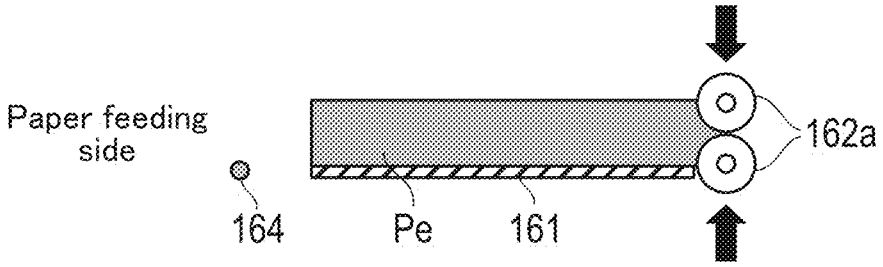
FIG. 3B is a diagram depicting a situation in which the processing unit crushes the empty paper pack.

Next, as depicted in FIG. 3B, the roller pair 162*a* sandwiches the back surface B of the empty paper pack Pe from upper and lower sides. Then, the roller pair 162*a* rotates while sandwiching the paper pack therebetween and starts to crush the empty paper pack Pe from the back surface B, as depicted in FIG. 3C. The roller pair 162*a* flatly crushes the empty paper pack Pe and pushes it out to the rear side as seen from the paper feeding side, thereby conveying the empty paper pack Pe to the discarding unit 163.

Figure 3C:
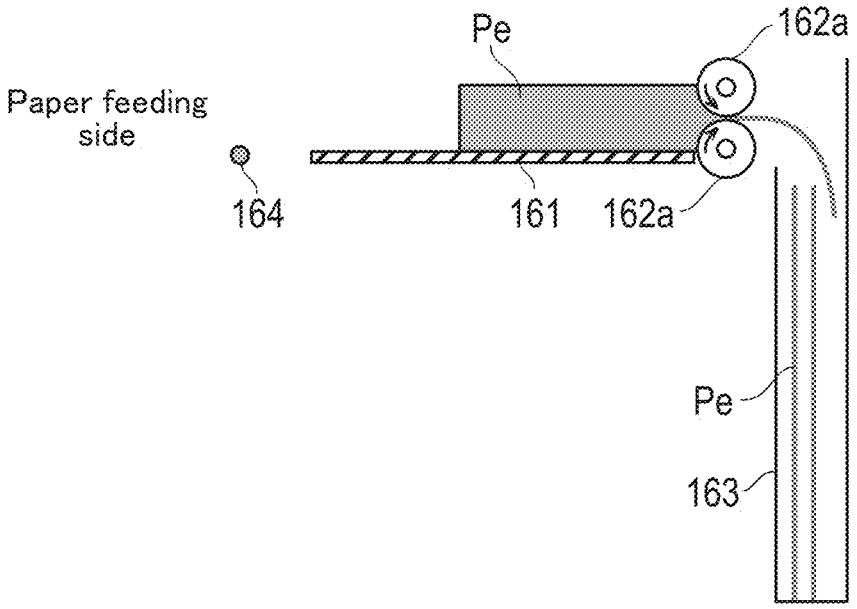
FIG. 3C is a diagram depicting a situation in which the processing unit conveys the empty paper pack to a discarding unit while crushing.

As depicted in FIG. 3C, the discarding unit 163 stores flat empty paper packs Pe conveyed from the roller pair 162*a*. Additionally, in crushing the empty paper pack Pe, the paper feeding roller 170 may be caused to retreat to a position away from the empty paper pack Pe.

As described above, according to the present embodiment, the accommodating device 160 flatly crushes the empty paper pack Pe from which all of the sheets of paper have been taken out and in which only the wrapping paper has remained, and conveys it to the discarding unit 163. Since the discarding unit 163 receives flatly crushed empty paper packs Pe, it can store more empty paper packs Pe than a case of storing uncrushed empty paper packs Pe. As a result, the accommodating device 160 can reduce the number of times that a user collectively takes out the empty paper packs Pe stored in the discarding unit 163 in order to discard them, so that the burden of the user can be relieved.

In addition, the accommodating device 160 starts to crush the empty paper pack Pe from the back surface B that is the wall surface opposing the wall surface on the paper feeding side among the wall surfaces of the paper pack P along the direction of stacking of the sheets of the paper. In other words, the processing unit 162 is arranged behind the accommodating unit 161 as seen from the paper feeding side. The processing unit 162 can be arranged without adjusting positional relationships with other configurations such as the paper feeding roller 170 and the paper conveying unit 180 which are arranged on the paper feeding side. As a result, as long as a space for arranging the processing unit 162 and the discarding unit 163 can be obtained behind the accommodating unit 161, the accommodating device 160 can process the empty paper pack Pe without obstructing the other configurations of the image forming apparatus 100.

Additionally, when crushing the empty paper pack Pe, the processing unit 162 of the accommodating device 160 moves to the position of the empty paper pack Pe. Accordingly, the processing unit 162 can directly process the empty paper pack Pe without moving it from a state after use.

In addition, the processing unit 162 of the accommodating device 160 comprises the roller pair 162*a*. The roller pair 162*a* rotates while sandwiching the empty paper pack Pe therebetween, thereby flatly crushing and conveying the empty paper pack Pe. In other words, in the accommodating device 160, the processing unit 162 comprising the roller pair 162*a* performs both of the processing for crushing and the processing for conveying to the discarding unit 163. Thus, the accommodating device 160 does not have to independently comprise each of a configuration for performing the processing for crushing and a configuration for performing the processing for conveying to the discarding unit 163. As a result, the accommodating device 160 can be actualized by a more simplified configuration. The processing unit 162 does not have to comprise the roller pair 162*a* as long as the processing unit 162 can flatly crush the empty paper pack Pe and can convey it to the discarding unit 163.

Additionally, the accommodating device 160 starts processing when the sensor 164 detects the absence of paper in the paper pack P. In other words, after all of the sheets of paper in the paper pack P have been taken out, the accommodating device 160 can automatically start processing and can rapidly complete the processing. Thus, the user does not have to issue an instruction to start processing to the accommodating device 160. As a result, the accommodating device 160 can improve user convenience. In addition, as the sensor 164, a remaining paper level sensor or the like that is usually incorporated in an image forming apparatus may be used.

In the above embodiment, one example of the accommodating device 160 has been described. However, the present invention is not limited thereto. Various changes, improvements, and the like as described below can be made.

As described hereinabove, the accommodating device 160 starts processing when the sensor 164 detects the absence of paper in the paper pack P. Meanwhile, when the sensor 164 detects the absence of paper in the paper pack P, the accommodating device 160 may notify to the user and may start processing after the user issues an instruction to start processing for crushing the empty paper pack Pe. The accommodating device 160 may notify to the user, for example, via the operation panel 140 of the image forming apparatus 100 and may receive the instruction from the user. Alternatively, the accommodating device 160 may notify to a PC (a personal computer) or the like of the user via the communication unit 130 of the image forming apparatus 100 and may receive the instruction input to the PC or the like via the communication unit 130. Since the user can cause the accommodating device 160 to perform the processing for crushing the empty paper pack Pe only when necessary, the accommodating device 160 can improve usability for users.

In addition, as described above, the accommodating unit 261, the processing unit 262, and the discarding unit 263 of the paper feeding device 200 are substantially the same as the respective configurations of the accommodating device 160. Thus, even in the paper feeding device 200, the accommodating device of the present invention can be actualized. In other words, the paper feeding device 200 can be formed so as to perform appropriate processing in order to discard the empty paper pack Pe remaining in the paper feeding device 200.

Additionally, in the above embodiment, the discarding unit 163 is arranged immediately behind the processing unit 162. However, the present invention is not limited thereto. The empty paper pack Pe flatly crushed by the processing unit 162 may be conveyed to the discarding unit 163 arranged in any selected place by using any desired conveying roller or the like. Thereby, the present invention can be actualized even when the discarding unit 163 cannot be arranged immediately behind the processing unit 162 due to the limited space of the accommodating device 160.

Hereinafter, further variations will be described with reference to the drawings.

(First Variation)

In the above embodiment, the processing unit 162 moves to the position of the empty paper pack Pe when crushing the empty paper pack Pe. In a first variation, the processing unit 162 itself does not move, and an other configuration moves the empty paper pack Pe.

Figure 4:
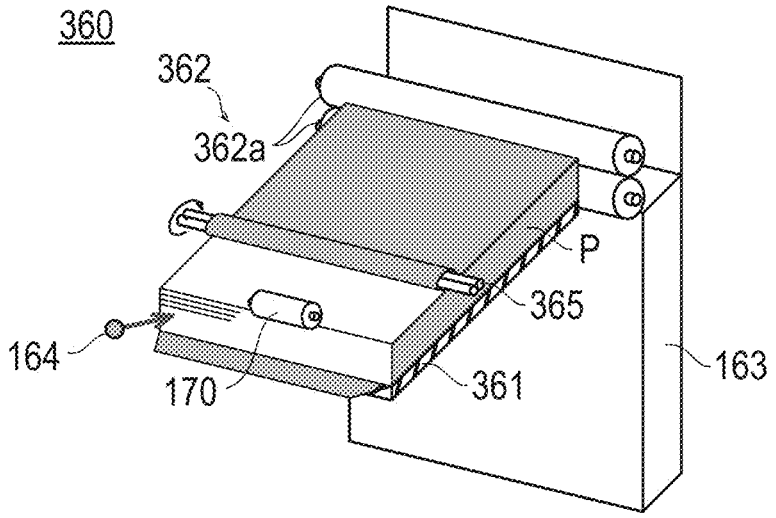
FIG. 4 is a perspective diagram depicting the schematic configuration of an accommodating device according to a first variation.

FIG. 4 is a perspective diagram depicting the schematic configuration of an accommodating device according to the first variation.

An accommodating device 360 of the first variation comprises an accommodating unit 361, a processing unit 362, the discarding unit 163, the sensor 164, and a conveying unit 365. The discarding unit 163 and the sensor 164 of the accommodating device 360 are substantially the same as the discarding unit 163 and the sensor 164 of the accommodating device 160, and thus, descriptions thereof will be omitted. In addition, in order to clarify a positional relationship between the respective configurations, the paper feeding roller 170 is also depicted together therewith in FIG. 4.

As depicted in FIG. 4, the accommodating unit 361 that supports an entire part of the paper pack P is different from the accommodating unit 161 that does not support the partial portion of the paper pack P including the back surface B. However, except for that, the accommodating unit 361 is substantially the same as the accommodating unit 161. The processing unit 362 comprising a roller pair 362*a* is different from the processing unit 162 in that the former does not move to the position of the empty paper pack Pe, while the latter moves to the position thereof. However, except for that, the processing unit 362 is substantially the same as the processing unit 162.

When crushing the empty paper pack Pe, the conveying unit 365 conveys the empty paper pack Pe to a position of the processing unit 362. For example, as depicted in FIG. 4, the conveying unit 365 comprises a set of bar-shaped members. The conveying unit 365 sandwiches and holds a partial portion of the empty paper pack Pe by the set of bar-shaped members, and moves to a direction of the processing unit 362, thereby conveying the empty paper pack Pe to the position of the processing unit 362. The conveying unit 365 does not have to comprise the set of bar-shaped members as long as the conveying unit 365 can hold a partical portion of the empty paper pack Pe.

Here, the conveying unit 365 is formed so as to be able to convey even a minimum-size empty paper pack Pe in which minimum-size sheets of paper had been wrapped. When seen in a plan view by assuming that the minimum-size empty paper pack Pe is mounted in the accommodating unit 361, the conveying unit 365 can hold even the minimum-size empty paper pack Pe as long as the conveying unit 365 is arranged in a position overlapping with the minimum-size empty paper pack Pe. The conveying unit 365 holds even an empty paper pack Pe having any size in the overlapping position. Then, the conveying unit 365 holds a partial portion of the empty paper pack Pe and moves to a direction of the processing unit 362, thereby conveying the empty paper pack Pe to the position of the processing unit 362.

When the image forming apparatus 100 comprises a mechanism for opening the paper pack P thereinside, the conveying unit 365 is formed by using a part of the mechanism. In the example depicted in FIG. 4, the conveying unit 365 moves to a rear side as seen from the paper feeding side and rolls up wrapping paper to open the paper pack P while rotating in an arrow direction in a state where it sandwiches a partial portion of the wrapping paper forming the wall surface on a paper feeding side among wall surfaces of the paper pack P along the direction of stacking of sheets of paper. In this case, the set of bar-shaped members of the conveying unit 365 performs both of the processing for opening the paper pack P and the processing for conveying the empty paper pack Pe to the position of the processing unit 362. Meanwhile, even when the image forming apparatus 100 comprises the mechanism for opening the paper pack P thereinside, the conveying unit 365 may be formed independently from the mechanism.

Hereinafter, details of processing performed by the accommodating device 360 will be described.

Figure 5A:
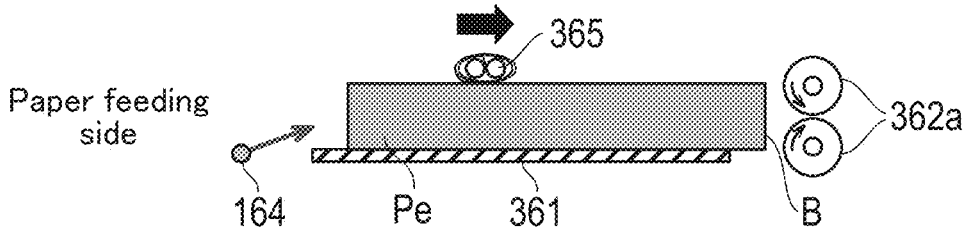
FIG. 5A is a diagram depicting a situation in which a conveying unit of the first variation conveys an empty paper pack.
Figure 5B:
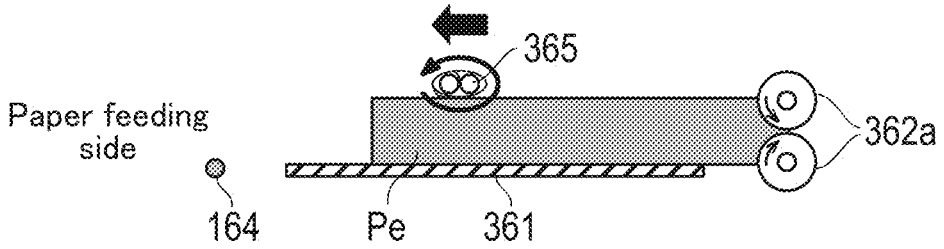
FIG. 5B is a diagram depicting a situation in which a processing unit of the first variation crushes the empty paper pack.

FIG. 5A is a diagram depicting a situation in which the conveying unit 365 of the first variation conveys an empty paper pack Pe. FIG. 5B is a diagram depicting a situation in which the processing unit 362 of the first variation crushes the empty paper pack Pe. In addition, FIGS. 5A and 5B depict states of the accommodating device 360 as seen from a lateral direction. In FIGS. 5A and 5B, the discarding unit 163 is omitted.

When the sensor 164 detects the absence of paper in the paper pack P accommodated in the accommodating unit 361, the conveying unit 365 conveys the empty paper pack Pe to a position of the roller pair 362*a*, as depicted in FIG. 5A. In this case, the conveying unit 365 does not rotate and moves toward the roller pair 362*a* in parallel to a bottom surface of the accommodating unit 361. Then, the conveying unit 365 presses the back surface B of the empty paper pack Pe to the roller pair 362*a* that is rotating in a direction that rolls the empty paper pack Pe.

Next, as depicted in FIG. 5B, the roller pair 362*a* sandwiches the back surface B pressed by the conveying unit 365 and starts to crush the empty paper pack Pe from the back surface B. When the roller pair 362*a* starts to crush the back surface B of the empty paper pack Pe, the conveying unit 365 starts to rotate in a direction (an arrow direction in FIG. 5B) opposite to the opening direction. By rotating in the arrow direction in FIG. 5B, the conveying unit 365 releases the empty paper pack Pe that it has held. The roller pair 362*a* flatly crushes the empty paper pack Pe and conveys it to the discarding unit 163. The discarding unit 163 stores flat empty paper packs Pe conveyed from the roller pair 362*a*. Additionally, in crushing the empty paper pack Pe, the paper feeding roller 170 may be caused to retreat to a position away from the empty paper pack Pe.

As described above, according to the first variation, the conveying unit 365 of the accommodating device 360 conveys the empty paper pack Pe to the position of the processing unit 362 when the processing unit 362 crushes the empty paper pack Pe. In this manner, the accommodating device 360 can process the empty paper pack Pe even when the position of the processing unit 362 is fixed and the processing unit 362 cannot move to the position of the empty paper pack Pe.

Additionally, the conveying unit 365 is formed by using the part of the mechanism for opening the paper pack P. Accordingly, the accommodating device 360 does not have to comprise the conveying unit 365 as an independent configuration, and can use an existing configuration in the image forming apparatus 100 as the conveying unit 365. As a result, the accommodating device 360 can be actualized by a more simplified configuration.

In addition, the conveying unit 365 is formed so as to be able to hold even an empty paper pack Pe in which minimum-size sheets of paper had been wrapped. Thereby, the accommodating device 360 can perform appropriate processing in order to discard even an empty paper pack Pe having any size.

Additionally, the first variation has been described, assuming that only one paper pack P is mounted in the accommodating unit 361. However, the invention is not limited thereto. The accommodating unit 361 may accommodate a plurality of paper packs P. In this case, the plurality of paper packs P will be used in order from an uppermost one. When the uppermost paper pack P becomes empty, the conveying unit 365 conveys only the empty paper pack Pe to the processing unit 362. The conveying unit 365 as an opening mechanism opens a part of a paper pack P that becomes uppermost in order, and conveys it to the processing unit 362 when the paper pack P becomes empty. Then, the processing unit 362 performs processing for discarding the empty paper pack Pe. In this manner, only the empty paper pack Pe is conveyed to the processing unit 362, so that the processing unit 362 does not interfere with any other paper pack P that is not empty yet. On the other hand, in a manner in which the processing unit goes close to the empty paper pack Pe, the processing unit interferes with any other paper pack P that is not empty yet. Thus, when a plurality of paper packs P are accommodated in one accommodating unit, the empty paper pack Pe can be processed by applying the first variation.

(Second Variation)

In the above embodiment, the accommodating device 160 flatly crushes the empty paper pack Pe. In a second variation, the accommodating device 160 not only flatly crushes the empty paper pack Pe but also performs additional processing on the flatly crushed empty paper pack Pe.

Figure 6:
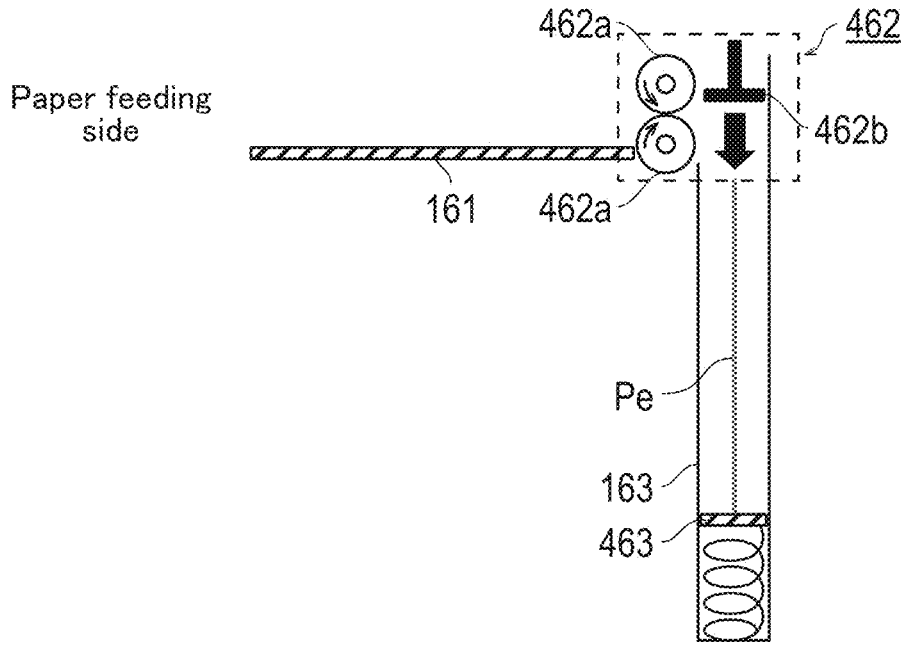
FIG. 6 is a cross-sectional diagram for illustrating a processing unit of a second variation.

FIG. 6 is a cross-sectional diagram for illustrating a processing unit of the second variation.

As depicted in FIG. 6, a processing unit 462 of the second variation comprises a roller pair 462*a* and a crushing unit 462*b*. The function of the roller pair 462*a* is substantially the same as the function of the roller pairs 162*a* and 362*a* of the above embodiment, and thus, a description thereof will be omitted.

The crushing unit 462*b* further crushes a flatly crushed empty paper pack Pe from a direction intersecting with a thickness direction of the flatly crushed empty paper pack Pe (a direction other than the thickness direction thereof). As depicted in FIG. 6, the crushing unit 462*b* is arranged behind the roller pair 462*a* as seen from the paper feeding side. The crushing unit 462*b* further crushes the empty paper pack Pe flatly crushed by the roller pair 462*a*, for example, from an upper side, as indicated by an arrow in FIG. 6. The crushing unit 462*b* may crush the flatly crushed empty paper pack Pe from any direction as long as it is a direction that intersects with the thickness direction and from which the flatly crushed empty paper pack Pe can be compressed. Then, the discarding unit 163 stores empty paper packs Pe crushed by the crushing unit 462*b*.

Here, in the case of crushing by the crushing unit 462*b*, for example, from the upper side, when the discarding unit 163 has a certain depth, the discarding unit 163 may further comprise a spring mount 463, as depicted in FIG. 6. In this case, it is sufficient for the crushing unit 462*b* to be able to move at least to a position where the crushing unit 462*b* reaches a base portion of the spring mount 463, whereby the crushing unit 462*b* can crush the flatly crushed empty paper pack Pe on the spring mount 463. On the other hand, when the crushing unit 462*b* can move to a position where it reaches a bottom surface of the discarding unit 163, the crushing unit 462*b* may crush the flatly crushed empty paper pack Pe on the bottom surface of the discarding unit 163.

As described above, according to the second variation, the accommodating device 160 further crushes the flatly crushed empty paper pack Pe from the direction intersecting with the thickness direction of the flatly crushed empty paper pack Pe. The accommodating device 160 can further compress the flatly crushed empty paper pack Pe by crushing from the direction intersecting with the thickness direction thereof. In other words, the discarding unit 163 receives the empty paper pack Pe further compressed than in the above embodiment. Thereby, the discarding unit 163 can store more empty paper packs Pe. As a result, the accommodating device 160 can further reduce the number of times that the user collectively takes out the empty paper packs Pe stored in the discarding unit 163.

In addition, in the second variation, the accommodating device 160 may collectively crush some of the plurality of flatly crushed empty paper packs Pe. The accommodating device 160 may be formed so as to start processing for crushing, for example, when the discarding unit 163 is filled with flatly crushed empty paper packs Pe.

Additionally, the second variation may be used in combination with the first variation. Specifically, the accommodating device 360 that conveys the empty paper pack Pe to the position of the processing unit 362 may also further comprise a crushing unit such as that of the second variation.

(Third Variation)

In the second variation, the accommodating device 160 further crushes the flatly crushed empty paper pack Pe, as additional processing. In a third variation, the accommodating device 160 performs another additional processing on the flatly crushed empty paper pack Pe.

Figure 7:
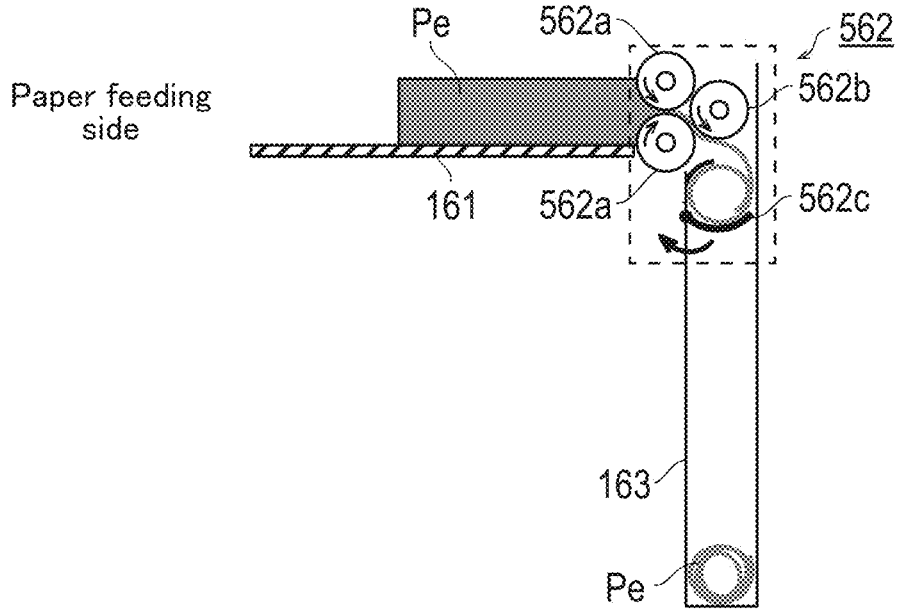
FIG. 7 is a cross-sectional diagram for illustrating a processing unit of a third variation.

FIG. 7 is a cross-sectional diagram for illustrating a processing unit of the third variation.

As depicted in FIG. 7, a processing unit 562 of the third variation comprises a roller pair 562*a*, a curling-inclination forming unit 562*b*, and a rolling unit 562*c*. The function of the roller pair 562*a* is substantially the same as the function of the roller pairs 162*a* and 362*a* of the above embodiment, and thus, a description thereof will be omitted.

The curling-inclination forming unit 562*b* forms a curling inclination on the empty paper pack Pe while flatly crushing the empty paper pack Pe in collaboration with the roller pair 562*a*. The curling-inclination forming unit 562*b* may be a single roller arranged behind the roller pair 562*a* as seen from the paper feeding side, as depicted in FIG. 7. The curling-inclination forming unit 562*b* rotates in sync with the roller pair 562*a* while sandwiching the empty paper pack Pe therebetween, and thereby squeezes the empty paper pack Pe and forms a curling inclination on the empty paper pack Pe. By differentiating the curling-inclination forming unit 562*b* from the roller pair 562*a* in terms of diameter size, surface hardness, and the like, the curling-inclination forming unit 562*b* can form a curling inclination on the empty paper pack Pe. The curling-inclination forming unit 562*b* may form the curling inclination by any method.

Next, the rolling unit 562*c* cylindrically rolls the empty paper pack Pe having the curling inclination formed thereon by the curling-inclination forming unit 562*b*, according to the curling inclination. As depicted in FIG. 7, the rolling unit 562*c* is arranged between the curling-inclination forming unit 562*b* and the discarding unit 163 in such a manner as to close a conveyance path to the discarding unit 163. The rolling unit 562*c* is a component having an arched cross-sectional shape. The rolling unit 562*c* is formed so as to cylindrically rolls the empty paper pack Pe having the curling-inclination formed thereon along the arched shape, as the empty paper pack Pe is conveyed from the roller pair 562*a* and the curling-inclination forming unit 562*b*. After rolling the empty paper pack Pe, the rolling unit 562*c* moves to a direction that opens the conveyance path to the discarding unit 163, as indicated by an arrow in FIG. 7, and conveys the cylindrically rolled empty paper pack Pe to the discarding unit 163. Then, the discarding unit 163 stores empty paper packs Pe cylindrically rolled by the rolling unit 562*c*.

As described above, according to the third variation, the accommodating device 160 forms a curling inclination on an empty paper pack Pe while flatly crushing the empty paper pack Pe, and cylindrically rolls the empty paper pack Pe having the curling inclination formed thereon according to the curling inclination. By cylindrically rolling the empty paper pack Pe, the discarding unit 163 receives the empty paper pack Pe further compressed than in the above embodiment. Thereby, the discarding unit 163 can store more empty paper packs Pe than in the above embodiment. As a result, the accommodating device 160 can further reduce the number of times that the user collectively takes out the empty paper packs Pe stored in the discarding unit 163.

In addition, by rolling the flatly crushed empty paper pack Pe, the accommodating device 160 can reduce, particularly, the size in a length direction or a width direction of the empty paper pack Pe. In other words, the third variation can be adapted even when the depth from the roller pair 562*a* to the bottom surface of the discarding unit 163 is not enough to directly store flatly crushed empty paper packs Pe in the discarding unit 163. By rolling an empty paper pack Pe before conveying it to the discarding unit 163 to reduce the size thereof in a single direction, the rolled empty paper pack Pe can be stored even in the discarding unit 163 that is shallow.

In the third variation, the processing unit 562 further comprises the curling-inclination forming unit 562*b* in addition to the roller pair 562*a*. However, the present invention is not limited thereto. Even without the addition of the curling-inclination forming unit 562*b*, a curing inclination can be formed by using a combination of two rollers having mutually different diameters, as the roller pair 562*a*. In this case, the roller pair 562*a* functions also as the curling-inclination forming unit 562*b*. In other words, the processing unit 562 of the third variation may actualize the same function by comprising the roller pair 562*a* which each roller has mutually different diameter and the rolling unit 562*c*. Additionally, the roller pair 562*a* may form a curling inclination by having mutually different surface hardness.

Additionally, the third variation may be used in combination with the first variation. Specifically, the accommodating device 360 that conveys the empty paper pack Pe to the position of the processing unit 362 may also further comprise a curling-inclination forming unit and a rolling unit such as those in the third variation.

In addition, the third variation may be used in combination with the second variation. Specifically, the processing unit of the accommodating device 160 may cause the curling-inclination forming unit 562*b* and the rolling unit 562*c* to cylindrically roll the empty paper pack Pe, and then may cause the crushing unit 462*b* to crush the cylindrically rolled empty paper pack Pe. Thereby, the discarding unit 163 receives the empty paper pack Pe further compressed by the effects of both of the second and the third variations, and therefore can store more empty paper packs Pe.

(Fourth Variation)

In the above embodiment, the accommodating device 160 starts to crush the empty paper pack Pe from the back surface B that is the wall surface opposing the wall surface on the paper feeding side among the wall surfaces of the paper pack P along the direction of stacking of sheets of paper. In a fourth variation, an accommodating device starts to crush the empty paper pack Pe from a different wall surface.

Figure 8:
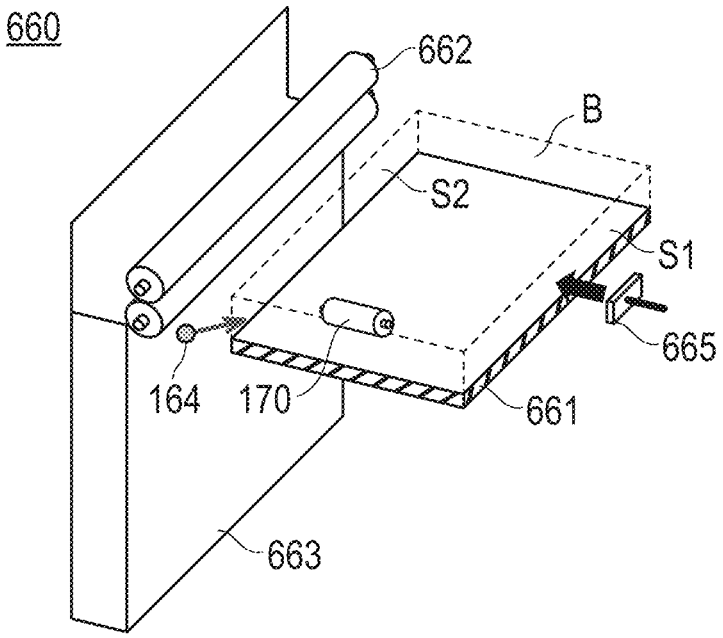
FIG. 8 is a perspective diagram depicting the schematic configuration of an accommodating device according to a fourth variation.

FIG. 8 is a perspective diagram depicting the schematic configuration of the accommodating device of the fourth variation.

An accommodating device 660 of the fourth variation comprises a processing unit 662 and a discarding unit 663 on a lateral side of an accommodating unit 661 as seen from the paper feeding side. These configurations are arranged in order of the accommodating unit 661, the processing unit 662, and the discarding unit 663 in a direction orthogonal to a paper feeding direction as seen in a plan view, as depicted in FIG. 8. In other words, the accommodating device 660 comprises the accommodating unit 661, the processing unit 662, and the discarding unit 663 that are arranged in a positional relationship different from that in the accommodating device 160 of the above embodiment and in the accommodating device 360 of the first variation. The accommodating unit 661, the processing unit 662, and the discarding unit 663 are substantially the same as the accommodating unit 361, the processing unit 362, and the discarding unit 363 of the accommodating device 360 except that the positional relationship between the respective configurations is different. In addition, the accommodating device 660 further comprises an extruding unit 665.

When a paper pack P accommodated in the accommodating unit 661 becomes empty, the extruding unit 665 extrudes the empty paper pack Pe and thereby presses it to the processing unit 662. The extruding unit 665 is, for example, a configuration having an extruding surface, as depicted in FIG. 8. However, the shape of the extruding unit 665 is not particularly limited as long as the extruding unit 665 is a configuration that can press the empty paper pack Pe to the processing unit 662.

Hereinafter, details of processing performed by the accommodating device 660 will be briefly described.

When the sensor 164 detects the absence of paper in the paper pack P accommodated in the accommodating unit 661, the extruding unit 665 extrudes the empty paper pack Pe toward the processing unit 662 in an arrow direction, as depicted in FIG. 8. The extruding unit 665 pushes one wall surface adjacent to the wall surface on the paper feeding side (hereinafter referred to as "side surface S1") among the wall surfaces of the paper pack P along the direction of stacking of sheets of paper, and presses an other wall surface adjacent to the wall surface on the paper feeding side (hereinafter referred to as "side surface S2") to the processing unit 662 that is rotating. In other words, the side surface S1 is positioned on a side where the extruding unit 665 is arranged, and the side surface S2 is positioned on a side where the processing unit 662 and the discarding unit 663 are arranged.

Next, the processing unit 662 sandwiches the side surface S2 pressed thereto by the extruding unit 665 and starts to crush the empty paper pack Pe from the side surface S2. Then, the processing unit 662 flatly crushes the empty paper pack Pe and conveys it to the discarding unit 663. The discarding unit 663 stores flat empty paper packs Pe conveyed from the processing unit 662. In addition, in crushing the empty paper pack Pe, the paper feeding roller 170 may be caused to retreat to a position away from the empty paper pack Pe.

As described above, according to the fourth variation, the accommodating device 660 starts to crush the empty paper pack Pe from the side surface S2 adjacent to the wall surface on the paper feeding side among the wall surfaces of the paper pack P along the direction of stacking of the sheets of the paper. The processing unit 662 is arranged at a position different from that of the processing unit 362 of the above embodiment. Thereby, the fourth variation can be actualized even when, due to the limited space, the processing unit 362 and the discarding unit 163 cannot be arranged immediately behind the accommodating unit 361 as in the first variation. As a result, as long as a space for arranging the processing unit 662 and the discarding unit 663 can be obtained on a lateral side of the accommodating unit 661, the accommodating device 660 can process the empty paper pack Pe without obstructing the other configurations of the image forming apparatus 100.

In other words, the accommodating device of the present invention can start to crush the empty paper pack Pe from the back surface B, as in the above embodiment, or alternatively can start to crush the empty paper pack Pe from the side surface S2, as in the fourth variation. Accordingly, when summarizing across the above embodiment and the fourth variation, it can be said that the accommodating device of the present invention starts to crush the empty paper pack Pe from any wall surface except for the wall surface on the paper feeding side among the wall surfaces of the paper pack P along the direction of stacking of sheets of paper.

In FIG. 8, the accommodating device 660 comprises the processing unit 662 and the discarding unit 663 on the left of the accommodating unit 661 and comprises the extruding unit 665 on the right of the accommodating unit 661, as seen from the paper feeding side. However, this is merely illustrative. As is obvious, it may be switched whether the respective units are arranged on the right or left side thereof.

In addition, the accommodating device 660 does not have to comprise the extruding unit 665. The extruding unit 665 can be omitted when the processing unit 662 can move to the position of the empty paper pack Pe, as in the processing unit 162 of the above embodiment. In this case, the accommodating unit 661 is formed so as not to support a partial portion of the empty paper pack Pe including the side surface S2 so that the processing unit 662 can sandwich the side surface S2.

Additionally, the fourth variation may be used in combination with the second variation and/or the third variation. Specifically, the accommodating device 660 that starts to crush the empty paper pack Pe from the side surface S2 may also further comprise the crushing unit of the second variation and/or the curling-inclination forming unit and the rolling unit of the third variation.

What is claimed is:

1. An accommodating device comprising:

an accommodating unit that accommodates a paper pack including a bundle of stacked sheets of printer paper wrapped with wrapping paper in such a manner that the printer paper is freely taken out;

a sheet feeder configured to individually remove sheets of printer paper from the bundle while the bundle remains in contact with the wrapping paper in the accommodating unit;

a processing unit that flatly crushes and conveys an empty paper pack which all of the sheets of the printer paper have been taken out from the paper pack and only the wrapping paper has remained; and a discarding unit configured to discard a flatly crushed empty paper pack which is obtained by crushing the empty paper pack and is conveyed from the processing unit.

2. The accommodating device according to claim 1, wherein the processing unit starts to crush the empty paper pack from a wall surface except for a wall surface on a paper feeding side among wall surfaces of the paper pack along a direction of stacking of the sheets of the printer paper.

3. The accommodating device according to claim 2, wherein the processing unit starts to crush the empty paper pack from a wall surface opposing the wall surface on the paper feeding side among the wall surfaces of the paper pack along the direction of stacking of the sheets of the printer paper.

4. The accommodating device according to claim 2, wherein the processing unit starts to crush the empty paper pack from a wall surface adjacent to the wall surface on the paper feeding side among the wall surfaces of the paper pack along the direction of stacking of the sheets of the printer paper.

5. The accommodating device according to claim 1, wherein the processing unit moves to a position of the empty paper pack when crushing the empty paper pack.

6. The accommodating device according to claim 1, further comprising a conveying unit that conveys the empty paper pack to a position of the processing unit when the processing unit crushes the empty paper pack.

7. The accommodating device according to claim 6, wherein the conveying unit holds the empty paper pack having any size in a position overlapping with a minimum-size empty paper pack in which minimum-size sheets of the printer paper had been wrapped, when seen in a plan view by assuming that the minimum-size empty paper pack is mounted in the accommodating unit so as to be able to hold even the minimum-size empty paper pack, and moves to a direction of the processing unit, thereby conveying the empty paper pack to the position of the processing unit.

8. The accommodating device according to claim 1, wherein the processing unit comprises a pair of rollers that flatly crushes and conveys the empty paper pack by rotating while sandwiching the empty paper pack.

9. The accommodating device according to claim 8, wherein the processing unit further comprises a crushing unit that further crushes the flatly crushed empty paper pack from a direction intersecting with a thickness direction of the flatly crushed empty paper pack.

10. The accommodating device according to claim 8, wherein the processing unit further comprises:

a curling-inclination forming unit that forms a curling inclination on the empty paper pack while flatly crushing the empty paper pack; and a rolling unit that cylindrically rolls the empty paper pack having the curling inclination formed thereon by the curling-inclination forming unit, according to the curling inclination.

11. The accommodating device according to claim 1, further comprising a sensor that detects a presence or absence of the printer paper in the paper pack, wherein the processing unit starts operation when the sensor detects the absence of the printer paper in the paper pack.

12. The accommodating device according to claim 1, wherein the processing unit starts operation when a user issues an instruction to start processing for crushing the empty paper pack.

13. An image forming apparatus comprising the accommodating device according to claim 1.

14. The image forming apparatus according to claim 13, wherein the image forming apparatus is configured to separate and convey individual sheets from the bundle of stacked sheets of printer paper while the bundle of stacked sheets of printer paper remains in the accommodating unit.

15. The image forming apparatus according to claim 13, comprising a paper feeding roller configured to separate and convey individual sheets from the bundle of stacked sheets of printer paper while the bundle of stacked sheets of printer paper remains in the accommodating unit.

16. The accommodating device according to claim 1, wherein the empty paper pack is crushed and conveyed at a same location as where the individual sheets are separated from the bundle of stacked sheets of printer paper.

17. The accommodating device according to claim 1, wherein the processing unit flatly crushes the entire empty paper pack.

18. The accommodating device according to claim 1, wherein the processing unit flatly crushes the empty paper pack so that the previously non-flat empty paper pack becomes flat.

* * * * *